United States Patent [19]

Poulos

[11] 4,336,832

[45] Jun. 29, 1982

[54] NON-SLIP HAMMER

[76] Inventor: Kosta Poulos, 1265 Newland Dr., Virginia Beach, Va. 23456

[21] Appl. No.: 208,113

[22] Filed: Nov. 18, 1980

[51] Int. Cl.[3] ..... B25C 1/00

[52] U.S. Cl. ..... 145/29 R; 145/2 R; 145/29 D

[58] Field of Search ..... 145/29 R, 29 D, 2 R

[56] References Cited

U.S. PATENT DOCUMENTS

| | | | |
|---|---|---|---|
| D. 35,652 | 2/1902 | David et al. | 145/2 R |
| 46,574 | 2/1865 | Montignani | 145/29 R |
| D. 137,738 | 4/1944 | Bradley | 145/29 R |
| D. 140,408 | 2/1945 | Henkel | 145/2 R |
| 440,962 | 11/1890 | Pettingell | 145/2 R |
| 869,381 | 10/1907 | McKoy | 145/2 R |
| 994,775 | 6/1911 | Nelson | 254/26 R |
| 1,428,287 | 9/1922 | Holmes | 145/2 R |
| 1,600,275 | 9/1926 | Darr et al. | 254/26 R |
| 1,614,055 | 1/1927 | Abraitis | 145/29 R |
| 2,018,573 | 10/1935 | Richardson et al. | 145/29 R |
| 4,200,130 | 4/1980 | Reamy | 145/29 R |

FOREIGN PATENT DOCUMENTS

| | | | |
|---|---|---|---|
| 728480 | 2/1966 | Canada | 145/29 R |
| 9135 | of 1894 | United Kingdom | 145/2 R |

*Primary Examiner*—James M. Meister
*Assistant Examiner*—J. T. Zatarga
*Attorney, Agent, or Firm*—Shoemaker and Mattare, Ltd.

[57] ABSTRACT

A hammer includes a head having a square impact face with a multiplicity of raised sections defined thereon. A nail puller is integrally joined to the head and is angled away therefrom.

3 Claims, 3 Drawing Figures

NON-SLIP HAMMER

BACKGROUND OF THE INVENTION

The present invention relates in general to hand tools, and, more particularly, to hammers.

Hammers are well known to all craftsmen, and have been used for generations. However, none of the known hammers provide efficient use of hammer surface area, and especially impact surface area, and none adequately prevent slipping and/or sliding of the element being impacted.

SUMMARY OF THE INVENTION

The hammer embodying the teachings of the present invention has a head with a square impact surface having a waffle-like surface area. A nail puller section is angled to depend from the top surface of the head, and has a teardrop shaped nail puller hole defined therein. The free edge of the nail puller has a sharpened tip, and can be used as a chisel, hatchet, or the like.

The hammer disclosed herein thus has the following advantages over known hammers:

1. The teeth prevent nails or the like from slipping and/or sliding on the face of the hammer, thereby enabling a worker to have good control when using the hammer for nailing.

2. The angle of the handle hole in the hammer head establishes a proper distance between the face of the hammer and the hammer handle to afford protection for the knuckles of the worker while using the hammer to extract nails.

3. The hammer has a thick angled bridge connecting the head to the nail puller, thereby giving good leverage for extracting and pulling nails out easily; the bridge is of such construction that it is stronger than the average construction-type hammer.

4. The square hammer head, as opposed to a round hammer head, gives more surface for driving nails and makes it easier to drive nails and wooden stakes.

5. The sharp outer edge of the hammer puller allows it to be used to chop or shape wood or the like during construction. In this way a worker would not have to use a plurality of tools to serve these purposes.

6. The sharp edge of the hammer could be used for sharpening small pieces of wood.

7. Because the hammer has a flat side surface, it can be used for driving a nail from the side while working in a small confined and/or cramped space wherein the swing of the hammer would be limited.

8. By reason of the combination of the nail puller, the flat driving surface and the sharpened blade, it makes an excellent tool for use by construction workers, cabinet makers and for use in home workshops.

OBJECTS OF THE INVENTION

It is a main object of the present invention to provide a versatile tool which can be used by a variety of workers.

It is another object of the present invention to prevent an element being struck from slipping during impact by a hammer.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
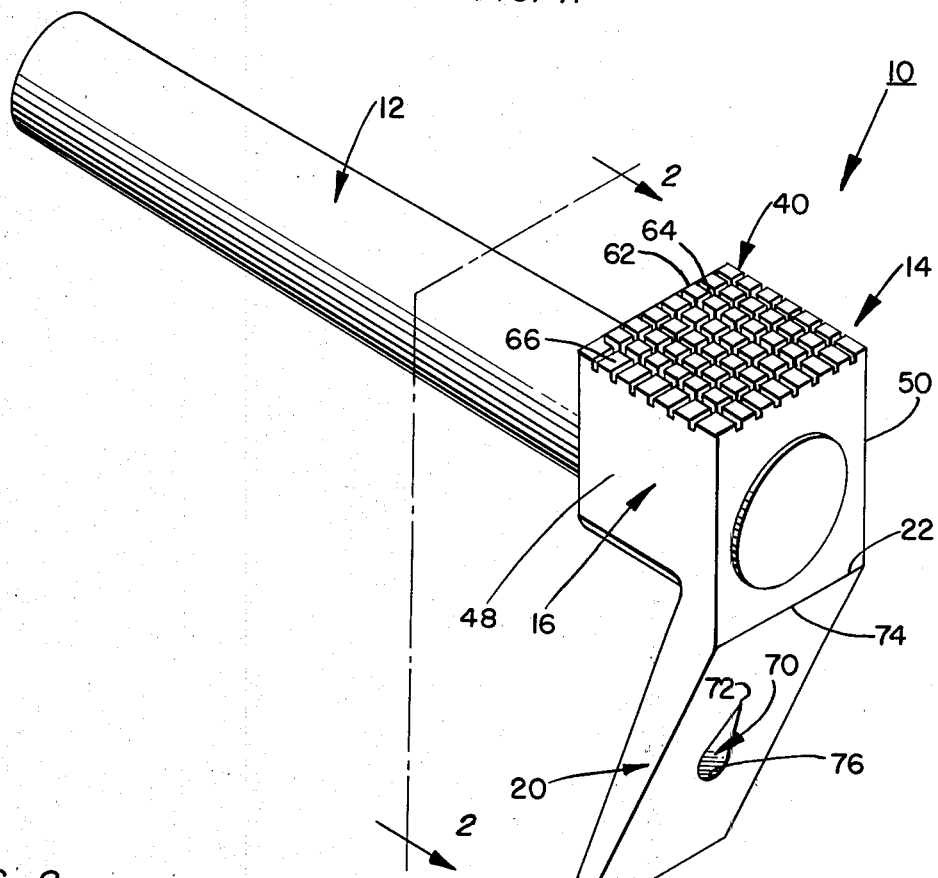
FIG. 1 is a perspective of a hammer embodying the teachings of the present invention.

Shown in FIG. 1 is a hammer 10 embodying the teachings of the present invention. The hammer includes an elongate handle 12 having a head 14 frictionally attached thereto at one end thereof.

Figure 3:
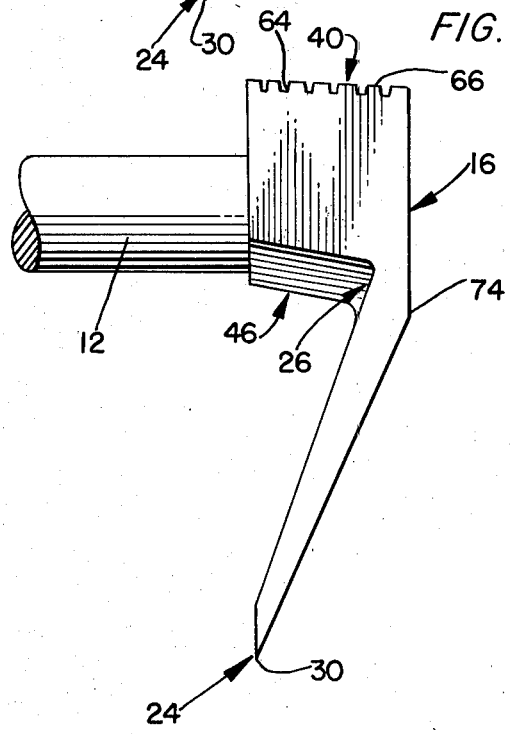
FIG. 3 is a side elevation of a hammer head embodying the teachings of the present invention.

The hammer head is unitary and includes a body section 16 having a bore defined therethrough for accommodating the handle. A nail puller section 20 is integrally attached to the body section at an angle to be rearwardly declining from joint 22 toward free edge 24. The joint forms a thick angled bridge 26 as best shown in FIG. 3. A sharp tip 30 is defined in the free edge of the nail puller and can function as a chisel, hatchet, or the like.

Figure 2:
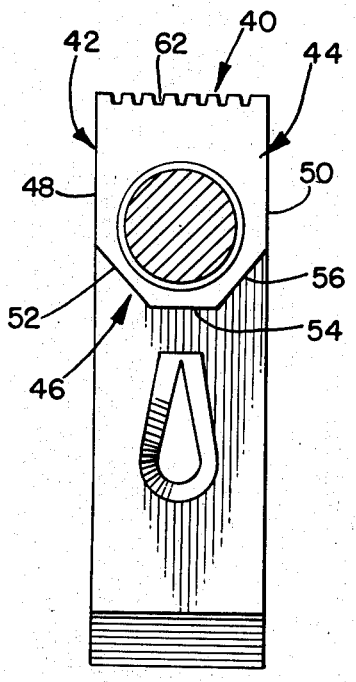
FIG. 2 is an elevation view taken along line 2—2 of FIG. 1.

The body section includes a square foreside 40, port side 42 and starboard side 44, with the nail puller extending rearwardly from the stern, or aft side 46 of the body section. The port and starboard sides are planar and have smooth faces 48 and 50, while the stern side has three faces 52, 54 and 56, as best shown in FIG. 2. The faces 42 and 44 can be used to drive nails, and the like, if necessary.

The stem side, or fore face 40, is waffle-like and includes a plurality of orthoganally arranged grooves 62 and 64 which form a bas-relief with outer surfaces 66 all being essentially uniplanar. The outer surfaces 66 form the primary impact surface of the hammer.

The fore side of the head is the primary impact surface, and the waffle-like face prevents nails from slipping and/or sliding on this face, thereby providing good control of the impact on the nail, or whatever element is being struck.

The square nature of the primary impact surface 40 provides substantial surface area for driving nails, wood stakes, and the like.

A teardrop shaped nail pulling hole 70 is defined in the nail puller section to have tip end 72 thereof located adjacent inner end 74 of the nail puller section, and body 76 located adjacent free edge 24 of the nail puller section. The hole 70 is used to extract nails from an element, and the nail is captured by the tail end of the hole. The inner edge 74 of the nail puller acts as a fulcrum to define a nail pulling lever.

The hammer head can be formed of any suitable material, such as metal, or the like, and can be of any suitable size.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A hammer comprising:

a handle having a longitudinal axis;

a heat mounted on said handle;

said head being unitary and integral and including a body section, and a nail puller section, and a bridge section connecting said body and nail puller sections together, said body section including a bottom, a planar top, planar parallel sides and a square impact face having a plurality of orthogonally arranged grooves defined therein to form a waffle-like surface having a multiplicity of raised sections which all have striking surfaces located in a common plane, said nail puller including a planar top, a planar undersurface and a nail pulling hole defined therein, said nail puller planar top being angled with respect to said body section to define a corner at the junction of said planar tops, said nail puller top being joined to said body planar top at a location so that said body planar top extends over said bridge section, said bridge section including a pair of extensions of said body section which are angled toward each other and a third section connecting said pair of extensions, said third section being oriented to be angled upwardly from said body bottom and outwardly away from the longitudinal axis of said handle so that there is an increasing thickness of said bridge section from said body bottom to the intersection between said third section and said nail puller section, a pair of corners being defined at the intersections between said angled extensions and said third section, and a pair of fillets connecting said extensions to said undersurface of said nail puller section, one of said fillets being located at each of said corners, so that said body and nail puller sections are securely connected together.

2. The hammer defined in claim 1 wherein said nail pulling hole is spaced from a top surface of said body section.

3. The hammer defined in claim 2 further including a free edge on said nail puller, said free edge being sharpened.

* * * * *